United States Patent [19]

Babb et al.

[11] 4,218,802

[45] Aug. 26, 1980

[54] DRAIN CLEANING APPARATUS

[75] Inventors: Larry F. Babb, La Grange; Walter J. Noveske, Elyria, both of Ohio

[73] Assignee: Emerson Electric Co., St. Louis, Mo.

[21] Appl. No.: 20,370

[22] Filed: Mar. 14, 1979

[51] Int. Cl.[2] ..... B08B 9/02

[52] U.S. Cl. ..... 15/104.3 SN

[58] Field of Search ..... 15/104.3 R, 104.3 SN

[56] References Cited

U.S. PATENT DOCUMENTS

| | | | |
|---|---|---|---|
| 2,318,172 | 5/1943 | Long | 15/104.3 SN |
| 2,460,149 | 1/1949 | Schoensiegel | 15/104.3 SN |
| 2,661,489 | 12/1953 | Rudolph et al. | 15/104.3 SN |
| 3,093,854 | 6/1963 | Silverman | 15/104.3 SN |
| 3,268,937 | 8/1966 | Bollinger | 15/104.3 SN |

FOREIGN PATENT DOCUMENTS

| | | | |
|---|---|---|---|
| 1409301 | 10/1975 | United Kingdom | 15/104.3 SN |

*Primary Examiner*—Edward L. Roberts

*Attorney, Agent, or Firm*—Polster, Polster and Lucchesi

[57] ABSTRACT

Drain cleaning apparatus utilizing a flexible snake which is inserted into a drain pipe and rotated so as to cut through a blockage or obstruction in the drain pipe. The apparatus includes a manually actuated chuck operable while the apparatus is in operation, for holding the snake relative to the apparatus thus enabling the operator to feed the snake forceably into the drain pipe and into cutting engagement with the obstruction, and auxiliary means operable to lock the snake securely with respect to the apparatus so as to permit the torque of the apparatus' drive motor to be applied to the snake.

10 Claims, 3 Drawing Figures

DRAIN CLEANING APPARATUS

BACKGROUND OF THE INVENTION

This invention relates to apparatus for cleaning a drain pipe or waste line, and more particularly to a hand held, portable tool for feeding a flexible snake into the drain pipe and for rotating the snake so as to cut through any obstruction or blockage in the drain pipe.

Drain pipes from plumbing fixtures, floor drains, and the like will, on occasion, become blocked with foreign matter (e.g., hair, paper, sludge, tree roots, grease, etc.) thus preventing water from flowing through the pipe. Conventionally, an elongate, flexible snake is inserted into the drain pipe and rotated for unblocking the pipe. These snakes are typically made of tightly coiled spring wire assembled from lengths of solid, flexible steel rods. Various styles of cutting tools may be affixed to the free end of the snake so as to cut through the obstruction in the pipe. A power driven unit is oftentimes used to rotate the snake, although hand cranks are sometimes used on smaller tools. Power driven units may range in size from large commercial models intended to clean out large municipal sewer lines (e.g., sewer lines 24 inches (61 cm.) or larger in diameter) to portable, hand-held units suitable for cleaning out the drain lines for bathroom sinks or the like.

In the larger, power driven units, the snake is usually positively fed forward and positively rotated by the apparatus. However, in smaller, hand-held units, the snake is typically coiled in a canister and is fed forward into a tubular guide, and the canister and the guide are rotated by a motor. The operator manually pulls out a length of the snake from the canister and guide, and manually feeds it into the drain pipe while the motor is operating. Normally, the friction of the snake on the inside surfaces of the canister and the guide is sufficient that the snake will rotate with the canister and guide so long as it does not encounter appreciable resistance to turning. This initial feeding of the snake into the drain pipe is normally a fast operation until the obstruction is encountered. The snake requires considerable axial force to cut through the obstruction.

When a particularly difficult obstruction stops the cutter from rotating, problems may arise. If most of the snake has been fed from the canister, the snake may slip with respect to the canister, rather than turning. If a large portion of the snake is still coiled within the canister, the snake may kink or twist within the canister.

To overcome these problems, prior art portable drain cleaners have frequently been provided with some locking means for releasably securing the snake to the guide so as to cause the snake to rotate with the guide. In one common prior art drain cleaner, the locking means is a collet, which grips the snake and locks it firmly and securely relative to the guide, to transmit the required torque to the snake and also to prevent axial movement of the snake with respect to the tool so that the snake may be forceably fed into the drain pipe. However, the collet requires the operator to stop the motor, loosen the chuck, pull out a desired length of the snake, tighten the chuck, and restart the motor to feed the additional length of the snake into the drain pipe.

Reference may be made to such prior art U.S. Pat. Nos. as 2,769,191, 3,244,024, 3,298,666, 3,449,782, 3,609,788 and 3,691,583 which disclose various portable drain cleaning device having means for holding the snake relative to the rotating guide. Other prior art devices have snake holding means which are operable while the tool is in operation (i.e., on the fly), but, in many instances, these snake holding means do not satisfactorily lock the snake to the guide so as to ensure that the snake will rotate with the guide under heavy load conditions and to transmit the maximum torque of the motor to the snake. In certain instances, these prior art locking devices allow slippage between the snake and the guide and this slippage results in either untwisting of the snake or in kinking of the snake with consequent damage thereto. While some of these prior art snake chucks are operable on the fly, they require that the operator hold them in their actuated position to grip the snake. Not only is this tiring to the operator, but requires the use of both hands at all times to operate the drain cleaner.

SUMMARY OF THE INVENTION

One of the objects of this invention is to provide drain cleaning apparatus, generally as above-described, in which the snake may be selectively held against axial movement with respect to the guide by a simple movement of the operator's hand while the apparatus is in operation;

Another object is to provide such a drain cleaner in which the snake may be securely locked against both axial and rotational movement relative to the guide and which does not require the operator to forcefully maintain locking engagement between the snake and the guide;

Another object is to provide such a drain cleaner which prevents damage to the snake caused by kinking of the snake within the canister;

Another object is to provide such a drain cleaner which enables the torque of the drive motor of the apparatus to be applied to the snake;

Another object is to provide such apparatus which can readily accept different sizes (i.e., diameters) of snakes without adjustment of the apparatus; and Another object is to provide such a drain cleaner which is of simple mechanical design, which requires little or no maintenance, which has a long service life, which does not require high operator skill, which is economical to manufacture, and which is reliable in operation.

Generally, a drain cleaning apparatus in the field of this invention includes a guide, and a flexible elongate snake extending through the guide adapted to be fed into a drain pipe and to be rotated for cleaning the drain pipe. Means is provided for rotating the guide, and other, means is carried by the guide for gripping the snake thereby to substantially prevent axial movement of the snake with respect to the guide and to permit the snake to be forced into the drain pipe. More specifically, the improvement of this invention involves the provision of a plurality of snake engaging members carried by the guide and moveable radially toward and away from the snake between a retracted position in which they are clear of the snake and in which the snake may be readily fed into or out of the guide, and a gripping position in which the snake engaging members are in engagement with the snake for substantially preventing axial movement of the snake with respect to the guide. Actuating means is provided operable during operation of the apparatus for selectively moving the snake engaging members between their retracted and gripping positions. An auxiliary locking means is provided for forcing the snake engaging members into gripping engagement with the snake thereby to lock the snake to the guide and to prevent rotation of the snake with respect to the apparatus. Other objects and features of this invention will be in part apparent and in part pointed out hereinafter.

DESCRIPTION OF PREFERRED EMBODIMENTS

Figure 1:
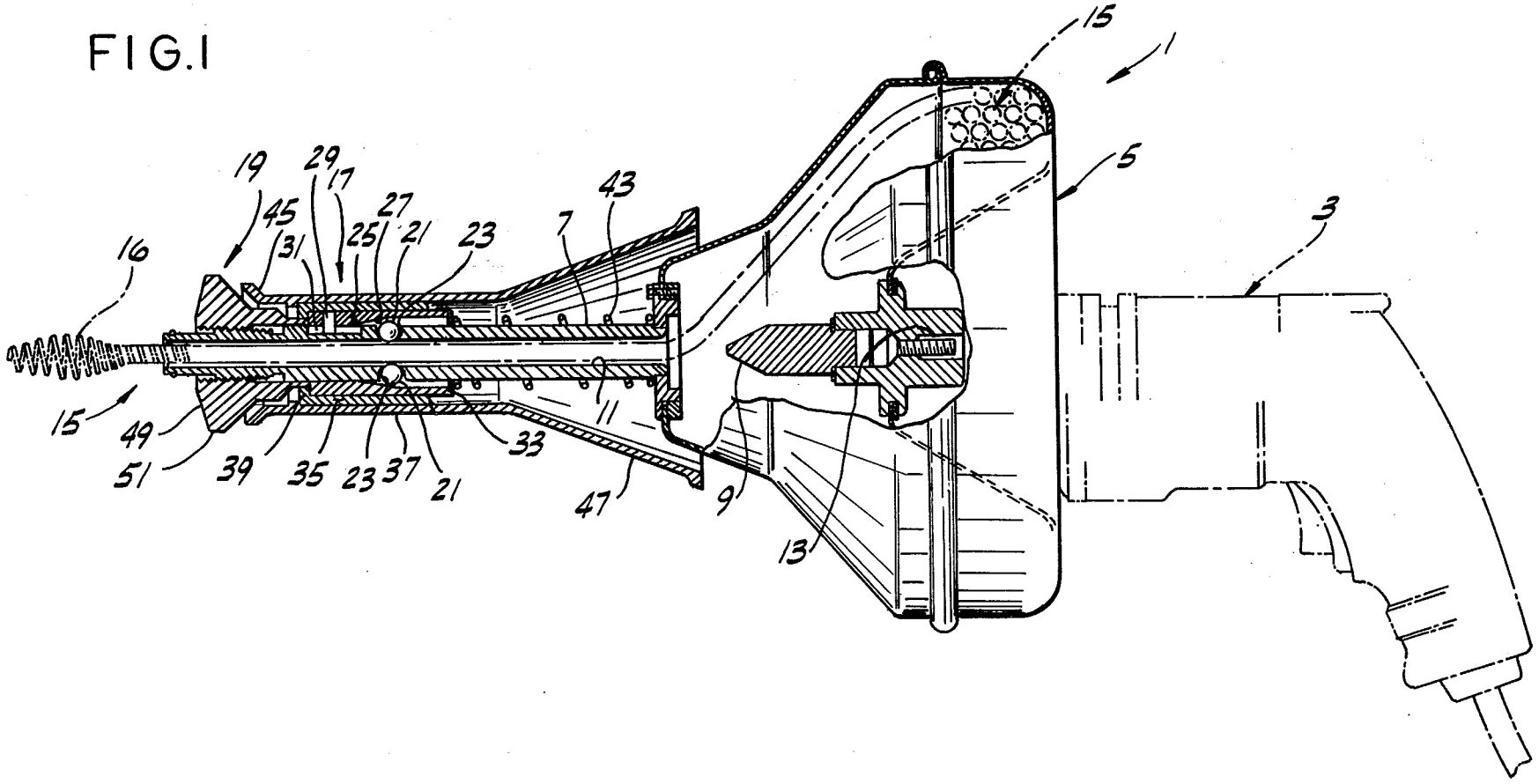
FIG. 1 is a longitudinal cross sectional view of a portable drain cleaning apparatus of this invention shown in its released position for the manual withdrawal of a snake from its storage canister.

Referring now to the drawings, a portable drain cleaning apparatus of this invention is indicated in its entirety at 1 and is shown to comprise a hand-held, trigger actuated motor 3 (shown in phantom in FIG. 1) at the rear of the apparatus, a canister or container 5 secured to the output shaft of the motor for rotating about a longitudinal center line or axis upon energization of the motor, and an elongate, tubular guide 7 secured to the front of the canister and rotatable therewith. A center snake guide 9 projects forwardly from the rear of the canister and is substantially coaxial with the centerline of the apparatus. The tubular guide 7 has a longitudinal opening 11 therethrough with the longitudinal axis of this opening being coaxial with the above-mentioned centerline (i.e., the axis of rotation of the apparatus). As shown, motor 3 is preferably a variable speed electrical drill motor with its output shaft speed being infinitely variable between zero and about 500 rpm. It will be understood, however, that other drive means may be used in conjunction with the apparatus of this invention. A socket 13 is provided in the rear of a snake guide 9 for reception of the output shaft of motor 3.

As generally indicated at 15, a snake or cable (also referred to as a tool) is coiled inside canister 5 and is guided by snake guide 9 for entrance into opening 11 of guide 7. As is conventional snake 15 is shown to be an elongate, flexible member made of tightly wound spring wire. The snake is coiled within canister 5 and may be readily manually pulled from the outer end of guide 7 for feeding out the snake or may be readily pushed back into the guide and hence back into the canister where it self winds in a coil for storage upon its removal from the drain pipe. Of course, snake 15 may be provided with various cutting tools, as indicated at 16, on its free end, or it may be provided with a coupler (not shown) on its free end for holding any desired cutting tool. The snake may, for example, be twenty-five feet (7.6 m.) long. Opening 11 is somewhat larger in diameter than the outer diameter of snake 15 so as to ensure that the snake will move freely within the guide.

In accordance with this invention, a hand operated chuck or locking device, indicated generally at 17, is provided to enable the operator to substantially prevent axial movement of snake 15 with respect to guide 7 on the fly (i.e., while the drain cleaning apparatus is in operation) thus enabling the operator to force feed the guide into a drain pipe and to apply additional torque to the snake as motor 3 is operated. Still further in accordance with this invention, an auxiliary locking device 19 is provided for securely locking the snake relative to guide 7 for positively preventing axial movement of the snake with respect to the guide and for securely locking the snake against rotation relative to the guide so that maximum thrust and torque loads may be applied to the snake and so that the snake will not twist and kink within canister 5.

Figure 2:
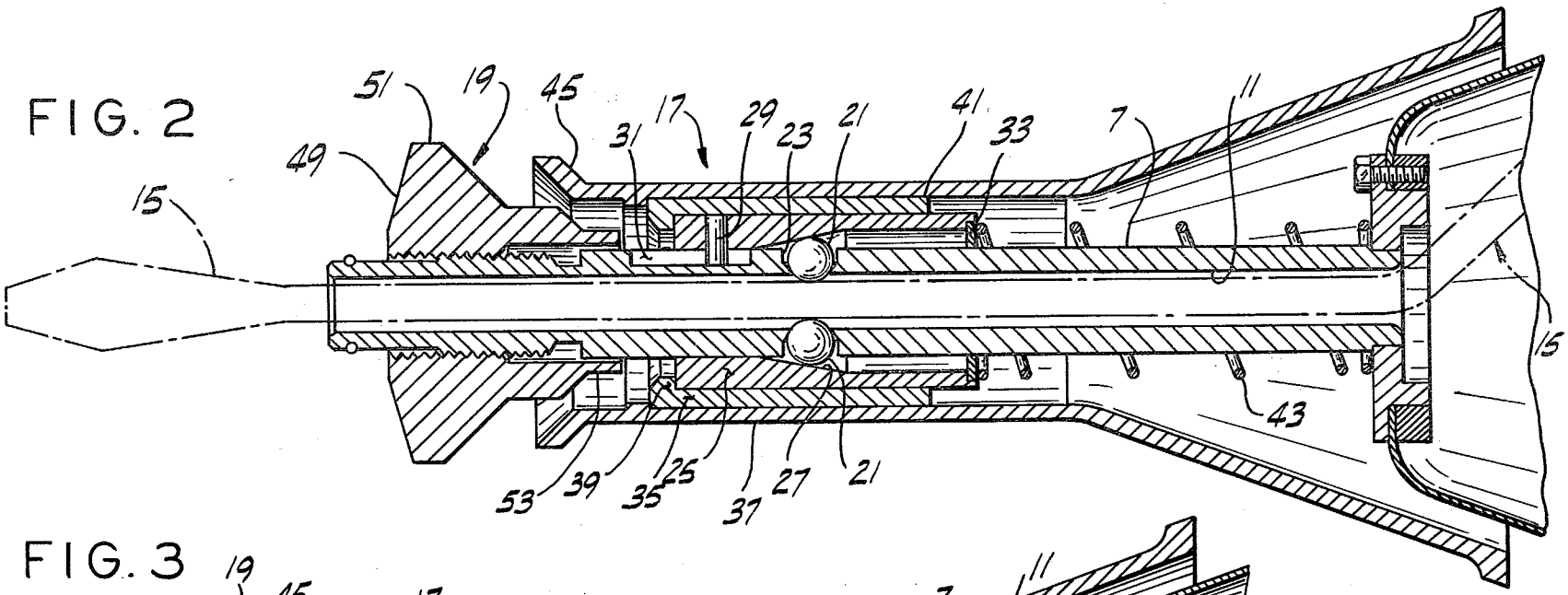
FIG. 2 is an enlarged portion of the apparatus shown in FIG. 1 illustrating manually operable means gripping the snake and preventing axial movement of the snake relative to the apparatus.
Figure 3:
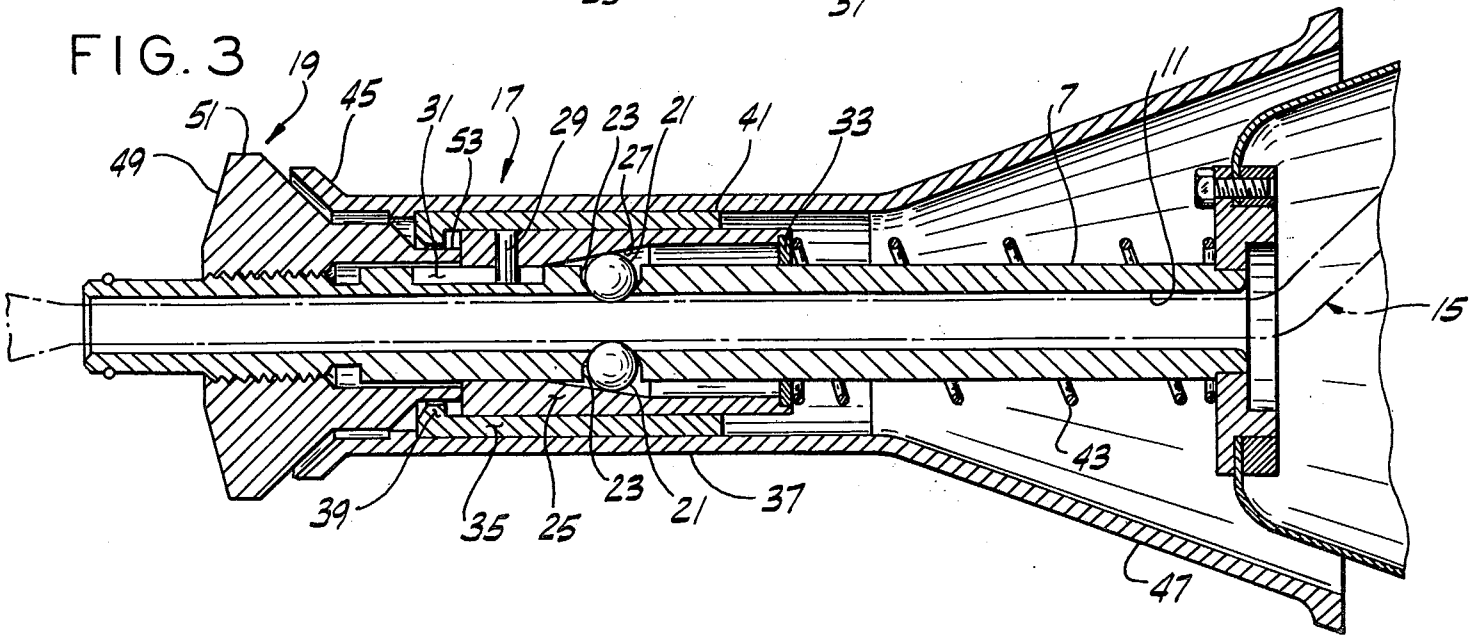
FIG. 3 is a view similar to FIG. 2 illustrating an auxiliary locking means in its locking position for firmly holding the snake relative to the guide so as to prevent both axial and rotational movement of the snake with respect to the apparatus.

More specifically, hand operated chuck 17 includes three snake-engaging elements 21, each of which is carried in a respective opening 23 in guide 7. As shown in the drawings, elements 21 are balls approximately five-sixteenths inch in diameter and are made of steel. However, it will be understood that within the broader aspects of this invention, elements 21 could also have been suitable pins or other shaped elements. Openings or aperatures 23 are equally spaced around a circumference of the guide intermediate the ends of the guide. Elements 21 are movable radially with respect to snake 15 toward and away from the snake between a retracted position (as shown in FIG. 1) in which they are clear of the snake or merely resting against it and a gripping position (as shown in FIGS. 2 and 3) in which the elements are in firm gripping engagement with the snake. Elements 21 are moved simultaneously from their retracted positions to their gripping positions by means of a sleeve 25 having an inner tapered or conical surface 27 which is smaller at its front than at its rear. The sleeve surrounds guide 7 and elements 21 and is movable axially relative thereto in fore and aft direction from a forward position, as shown in FIG. 1, in which its tapered surface 27 permits the elements to move outwardly with respect to snake 15 to their retracted positions, to a rearward position, as shown in FIGS. 2 and 3, in which the tapered surface simultaneously, engages the elements and forces them radially inwardly into gripping engagement with the snake. A stop pin 29 carried by sleeve 25 rides in an axial groove 31 in guide 7 to ensure that the sleeve rotates with the guide. The rear end of sleeve 25 is slideably supported on guide 7 by means of a support washer 33.

As shown in the drawings, openings 23 are countersunk, with the inner ends smaller than the diameter of elements 21 thereby to prevent the elements from falling through the openings upon removal of the snake. Of course, with sleeve 25 at all times being on the outside of the elements, the elements are held captive in their openings. In accordance with this invention, apparatus 1 may utilize various sizes (i.e., diameters) of snakes without adjustment of the apparatus. More specifically, opening 11 in guide 7 and the diameter and inward reach of elements 21 are so selected that, for example, they can accept snakes having a $\frac{3}{8}$ inch (0.95 cm) or 5/16 inch (0.79 cm) outside diameter.

The sleeve 25 is journalled in a bronze-type bearing or bushing 35 which surrounds the sleeve. A tubular handle or hand grip 37 surrounds the bearing 35 and is secured to it. Thus, the operator of the apparatus of this invention may readily manually grasp handle 37 and hold it stationary while permitting sleeve 25 to rotate with guide 7. As shown, bearing 35 has an inwardly extending shoulder 39 abutting the front face of sleeve 25. The bearing is affixed (shrink fitted) within handle 37 thereby to fix its axial position with respect to the handle. Accordingly, as handle 37 is moved rearwardly, shoulder 39 of bearing 35 is forced into engagement with the front face of sleeve 25 thereby to shift the sleeve rearwardly, and to in turn move elements 21 inwardly. A compression coil spring 43 surrounds guide 7 and is interposed between the forward end of canister 5 and the rear end of sleeve 25 so as to resiliently bias the sleeve and handle 37 forward. Support washer 33 serves as a stop for spring 43.

Handle 37 has a forward flared end 45 and an enlarged, funnel-shaped rear end 47 spaced from and extending around the front portion of canister 5. This rear end portion of the handle is preferably (but not necessarily) flared at generally the same angle as the forward portion of the canister and, with the handle in its forward position (see FIG. 1), it is spaced from the canister so as to permit rearward movement of the handle with respect to the canister. This flared rear portion of the handle thus serves as a shield so as to prevent the operator's fingers or foreign material from contacting the rotating guide 7 and spring 43 therewithin.

As mentioned above, apparatus 1 of this invention further includes an auxiliary locking device 19. This auxiliary device comprises a locking nut or cap 49 threaded on the outer end of guide 7 forward of sleeve 25. The nut 49 has an outer peripheral surface 51 which may be readily manually gripped by the operator to turn the nut and to thread it forward or rearward direction, as desired, on guide 7. The nut further has a skirt 53 which surrounds the guide and which extends rearwardly for engagement with the forward end of sleeve 25.

Upon turning nut 49 so as to thread it in rearward direction on guide 7 toward sleeve 25, its rearwardly extending skirt 53 will engage the sleeve 25. With skirt 53 in engagement with the sleeve 25, further turning of the nut to move it in rearward direction will shift the sleeve rearwardly and force elements 21 inwardly into firm gripping engagement with snake 15. Because high axial forces can be generated on sleeve 25 by turning nut 49, elements 21 can be more firmly brought into gripping engagement with snake 15 than they can be by manually moving handle 37 rearwardly. Thus, the manual rearward shifting of handle 37 securely locks the snake against axial movement with respect to the guide. The inward radial force manually applied to the elements by the rearward movement of handle 35 is sufficient to allow increased torque from motor 3 to be applied to the snake via elements 21, but it is not in all cases sufficient to securely lock the snake against rotating relative to the guide so as to transmit the torque of the motor to the snake. By stopping the motor 3 and forcefully threading nut 49 inwardly against the forward end of sleeve 25, the elements 21 are forced into even tighter engagement with the snake, and auxiliary locking means 19 can be used to firmly lock the snake against both rotation and axial movement relative to the guide. The locking force produced is sufficient to isolate the length of snake in the canister from axial and rotational forces generated at the cutter end of the snake. When a particularly difficult obstruction locks the cutter 16 in one direction of rotation, any kinking or twisting of the snake 15 will occur between cutter 16 and elements 21; in the other direction of rotation, the turns of the wire snake will tend to unwind between the cutter 16 and the balls 21.

Numerous variations in the drain cleaning apparatus of this invention, within the scope of the appended claims will occur to those skilled in the art in light of the foregoing disclosure. For example, while hand-operated chuck 17 and auxiliary locking means 19 of this invention have been shown herein for use on a hand-held, electric motor-driven drain cleaner, it will be understood that they could be used with larger or smaller drain cleaners. It will be further understood that while chuck 17 and auxiliary locking means 19 have been herein used in conjunction with a coiled spring wire snake and a canister, the chuck and auxiliary locking means could also be used with a solid rod snake and without a canister. Although the auxiliary locking means 19 are preferably independent of the manually operated handle 37 and bearings 35, they may be interconnected if desired. Some of the advantages of the present invention may be obtained using different manually operated and auxiliary locking means, or by the preferred manual locking means. These variations are merely illustrative.

What is claimed is:

1. In a drain cleaning apparatus having a guide, a flexible, elongate snake extending through the guide and being adapted to be fed into a drain pipe or the like and to be rotated for cleaning the drain pipe, means for rotating said snake and said guide, a plurality of snake engaging members movable radially toward and away from said snake between a released position in which said snake may be readily fed into or out of said guide and a gripping position in which said snake engaging members are in engagement with said snake for substantially preventing axial movement of the snake with respect to the guide, and actuating means operable during operation of said apparatus for moving said snake engaging members between their released and gripping positions, the improvement comprising: selectively operable auxiliary locking means for locking said tool engaging members in engagement with said tool, said actuating means comprising axially movable means movable to and from an axial position in which said axially movable means engage said snake engaging means and cause said snake engaging means to engage said snake, and handle means rotatably mounted with respect to said axially movable means for axially moving said axially movable means to said axial position while said snake and guide are rotating, said auxiliary locking means comprising means for locking said axially movable means in said axial position including a locking member carried on said guide and movable axially on said guide for engaging said axially movable means independent of said handle means.

2. Apparatus as set forth in claim 1 wherein said guide is a tubular member, wherein said snake is adapted to extend axially through said tubular member from rear to front and to be fed forward into said drain pipe, wherein said tool engaging members comprise a plurality of balls carried by said guide and movable radially with respect to said guide between their retracted and gripping positions, and wherein said actuating means comprises a sleeve surrounding said guide and said balls, said sleeve having a tapered inner surface engageable with said balls, said sleeve being axially movable in rearward direction with respect to said guide and said inner surface being simultaneously engageable with said balls for forcing them radially inward with respect to said guide into gripping engagement with said snake, said sleeve being movable in forward direction thereby to effect the release of said balls from gripping engagement with said snake.

3. Apparatus as set forth in claim 2 wherein said actuating means includes a handle movable axially relative to said guide for effecting rearward shifting of said sleeve on said guide, and a bearing between said handle and said sleeve so that said handle may be readily held against rotation with respect to said guide.

4. Apparatus as set forth in claim 3 wherein said auxiliary locking means comprises a locking nut threaded on said guide in front of said sleeve, said locking nut having a rearwardly extending portion engageable with said sleeve, said nut being threadably movable on said guide in rearward direction to engage said sleeve, to move said sleeve rearwardly on said guide thereby to move said balls inwardly into gripping engagement with said snake and to lock said sleeve against forward movement relative to the guide so as to lock the snake with respect to the guide.

5. Apparatus as set forth in claim 4 further comprising a spring for biasing said sleeve forward on said guide thereby to effect the release of said snake upon the release of said handle or said locking member.

6. Apparatus as set forth in claim 4 wherein said apparatus further includes a canister secured to the rear end of said guide and rotatable therewith for storage of said snake.

7. Apparatus as set forth in claim 6 wherein said means for rotating said tool and said guide comprise power driven means attached to said canister for rotating said canister and said guide.

8. A hand-held, power-driven drain cleaning apparatus comprising a motor at the end of said apparatus, a canister secured to said motor for rotation by the motor about a longitudinal axis upon energization of the motor, an elongate tubular guide secured to the forward end of said canister coaxial with said longitudinal axis, said guide being rotatable with said canister, an elongate, flexible drain pipe cleaning snake adapted to be coiled up within said canister and to extend forwardly through said guide, a plurality of apertures through said guide and spaced around the periphery of said guide, a ball disposed in each of said apertures, each said ball being movable radially with respect to said guide between a retracted position in which it is free of said snake extending through said guide and a gripping position in which it engages said snake, a sleeve surrounding said guide and said balls, said sleeve having an inner tapered surface engageable with said balls, and being movable axially on said guide, said tapered surface engaging said balls and forcing them radially inwardly into gripping engagement with said snake upon said sleeve being moved rearwardly on said guide, said tapered surface being movable free of said balls upon said sleeve being moved forwardly on said guide, a manually operable handle surrounding said sleeve and being operatively connected thereto for shifting said sleeve rearwardly upon the user of said apparatus manually gripping said handle and moving it rearwardly thereby to effect the inward movement of said balls into gripping engagement with said snake so as to substantially prevent axial movement of said snake with respect to said guide, said handle being operable while said motor is in operation and while said canister and said guide are rotating, bearing means interposed between said sleeve and said handle thereby to permit said sleeve to rotate with said guide independently of said handle, and auxiliary actuating and locking means operable independently of said handle for locking said sleeve against forward movement relative to said guide and for holding said balls into secure locking engagement with said snake thereby to firmly lock said snake to said guide for rotation of the snake with the guide.

9. Apparatus as set forth in claim 8 further including a spring biasing said sleeve forwardly.

10. A portable, hand held drain cleaner comprising a motor adapted to be manually held, a canister rotatably driven by said motor about its central longitudinal axis, an elongate, flexible snake coilable in and un-coilable from said canister, a tubular guide secured to said canister and extending in forward direction from the canister, said guide having an opening therethrough for receiving said snake, said opening being coaxial with said longitudinal axis, said guide having a plurality of openings therethrough spaced around the guide at a location intermediate the canister and the free end of the guide, a snake engaging member disposed in each of said openings, a sleeve having a tapered inner surface movable axially with respect to said guide in fore and aft direction between a retracted position in which the snake engaging members are free to move radially outwardly with respect to the snake thereby to permit the snake to move freely within said guide and an inner gripping position in which the snake engaging members are in engagement with the inner surface of said sleeve and with said snake, a hand grip movable with respect to said guide means, interconnecting said hand grip and said sleeve for effecting movement of the sleeve and for effecting engagement of said snake engaging members on the snake thereby to at least partially lock said snake to said guide, and an auxiliary locking member carried by said guide and being movable axially thereon for forcing said sleeve axially so as to in turn force said snake engaging members into firm gripping engagement with said snake and for locking said sleeve in said axial position.

* * * * *

UNITED STATES PATENT AND TRADEMARK OFFICE

CERTIFICATE OF CORRECTION

PATENT NO. : 4,218,802

DATED : August 26, 1980

INVENTOR(S) : Larry F. Babb et al

It is certified that error appears in the above-identified patent and that said Letters Patent are hereby corrected as shown below:

Column 1, line 65, "3,244,024" should be "3,224,024".

Column 6, line 66, "radially inward" should be "radially inwardly".

Signed and Sealed this

Tenth Day of March 1981

[SEAL]

*Attest:*

RENE D. TEGTMEYER

*Attesting Officer* *Acting Commissioner of Patents and Trademarks*